US005293884A

United States Patent [19]

Chapman et al.

[11] Patent Number: 5,293,884

[45] Date of Patent: Mar. 15, 1994

[54] LOOP STRAP HAIR TIE

[75] Inventors: R. David Chapman, Salt Lake City, Utah; David K. Hays, Bellevue, Wash.; Barry Levenson, Sherman Oaks; Scott A. Miller, LaVerne, both of Calif.

[73] Assignee: Full Moon Fashion Accessories, Inc., Boulder, Colo.

[21] Appl. No.: 818,691

[22] Filed: Jan. 8, 1992

[51] Int. Cl.[5] ..... A45D 24/00

[52] U.S. Cl. ..... 132/200; 132/273

[58] Field of Search ..... 132/245, 246, 248, 222, 132/273, 275, 200; 24/16 R

[56] References Cited

U.S. PATENT DOCUMENTS

| | | | |
|---|---|---|---|
| D. 173,167 | 10/1954 | Neerup | D86/10 |
| 1,176,910 | 3/1916 | Lee | 132/273 |
| 1,424,654 | 8/1922 | Kitson | 132/273 |
| 1,626,433 | 4/1927 | Siner | 132/273 |
| 2,488,954 | 11/1949 | Winters | 132/48 |
| 2,649,097 | 8/1953 | Chernack | 132/246 |
| 2,700,977 | 2/1955 | Neerup | 132/46 |
| 2,945,500 | 7/1960 | Bolinger | 132/47 |
| 3,000,384 | 9/1961 | Piers | 132/46 |
| 3,525,376 | 8/1970 | Muhlauser | 150/52 |
| 3,542,041 | 11/1970 | Mercorella | 132/46 |
| 3,842,849 | 10/1974 | Goodman | 132/46 R |
| 4,088,136 | 5/1978 | Hasslinger et al. | 24/16 R |
| 4,394,782 | 7/1983 | Wasson | 2/181 |
| 4,406,296 | 9/1983 | Wexler et al. | 132/275 |
| 4,700,432 | 10/1987 | Fennell | 24/16 R |
| 4,785,834 | 11/1988 | Gonzalez | 132/275 |
| 4,815,172 | 3/1989 | Ward | 24/16 R |
| 4,862,563 | 9/1989 | Flynn | 24/442 |
| 4,892,110 | 1/1990 | Harvie | 132/273 |
| 4,893,381 | 1/1990 | Frankel | 24/16 R |
| 4,939,818 | 7/1990 | Hahn | 24/16 R |
| 5,025,816 | 6/1991 | Jones | 132/245 |
| 5,081,748 | 1/1992 | Eberle | 24/442 |
| 5,086,543 | 2/1992 | Mitchell | 24/16 |
| 5,097,854 | 3/1992 | Smith | 132/275 |
| 5,142,743 | 9/1992 | Hahn | 24/16 |

FOREIGN PATENT DOCUMENTS

| | | |
|---|---|---|
| 0258015 | 3/1988 | European Pat. Off. . |
| 6700321 | 4/1968 | Netherlands . |

OTHER PUBLICATIONS

Photographs of Prior Art, 1989 "Hair Wrappers" by Jontee Accessories.

*Primary Examiner*—Gene Mancene
*Assistant Examiner*—Frank A. LaViola
*Attorney, Agent, or Firm*—Elman Wilf & Fried

[57] ABSTRACT

A hair tie to fasten locks of hair into pony tails, braids or dred locks. The hair tie comprises a generally planar, elongated material containing corresponding fastening surfaces at each end. The hair tie encircles the lock of hair in a belt-like fashion and fastens upon itself. The hair tie is capable of tying different amounts of hair by varying the positions the ends of the hair tie engage. Additionally, the hair tie incorporates an elastic loop and a friction pad to ensure the hair tie securely attaches and remains in position on the lock of hair. Ornamentation, such as jewelry, beads and ribbon, printing and logos may decorate the hair tie, allowing individuals to decorate their hair as well as fasten it.

36 Claims, 6 Drawing Sheets

LOOP STRAP HAIR TIE

FIELD OF THE INVENTION

The invention relates generally to fastening devices and more particularly to a hair tie which is adapted to be placed in an encircling relation about a lock of hair such as a pony tail.

BACKGROUND OF THE INVENTION

Devices to fasten locks of hair in a pony tail, braids or dred locks are generally well known, but suffer from a number of drawbacks. Many hair ties have as their predominate tying feature some sort of elastic band that requires the user to loop and twist about a lock of hair. These hair ties are sometimes difficult to apply. In addition, some of the elastic band hair ties on the market have numerous small metal pieces on the elastic loop, which can pull out or damage the hair. Other hair ties require knots that must be tied by the user in order to properly secure the hair in a pony tail. Some are difficult to tie to the hair, and sometimes the user may need assistance from a second person to help attach the hair tie. In addition, certain hair ties are unreliable in that they fail to remain in place on the pony tail. This drawback requires the wearer to adjust the hair tie intermittently. Some hair ties also provide limited flexibility to adjust and allow the user to choose different amounts of hair that may be fastened by a single hair tie at any one time. Furthermore, certain hair ties do not permit the hair tie to be decorated in a way that enhances the appearance of the wearer.

SUMMARY OF THE INVENTION

It is accordingly a primary objective of the present invention to provide a hair tie which will avoid the drawbacks stated above.

The present invention provides a new means of securing a lock of hair into a pony tail, braid or dred lock. The foundation for the hair tie is a generally planar, elongated element forming a loop strap that is sufficiently flexible to encircle a lock of hair in a belt-like fashion. By sufficiently flexible, it is meant that the elongated element may be made from one or more of a variety of material or fabrics including but not limited to suede, leather, polyester, silk, cotton or vinyl. A surface of fastening tape is attached to the inside face of the element or loop strap, and a corresponding surface of fastening tape is attached to the outside face of the loop strap. The loop strap encircles a lock of hair in a belt-like fashion, and the fastening tape surfaces detachably engage to secure the lock of hair into a pony tail, braid or dred lock.

When the hair tie is in the proper position on the wearer's hair, decorative ornaments are visible to a third person. The ornaments may be placed on the outside face of the loop strap or attached to a loop strap tail. The loop strap tail is an extension of the loop strap. It provides another surface for mounting decorative ornaments such as beads, studs, rhinestones, jewelry, braided rope, ribbon, etc. The loop strap and loop strap tail also provide a surface to emboss or print names or logos. In this manner, the hair tie may be decorated to the preference of the user.

The fastening tape surfaces attached to the inside and outside faces of the loop strap preferably comprise fibrous loop and hook fastening material respectively. For purposes of this specification, the "hook fasteners" and "fibrous loop fastening material" should be understood as designating fasteners of the same general type as those distributed under the trademark Rip 'N Grip TM. Similar fastening material is sold under the trademarks VELCRO, SCOTCHMATE and MASTEX. Preferably, secured on the inside face of the loop strap is a surface of fibrous loop fastening material, or female fastening tape. When the female tape wraps around a lock of hair, the tape connects with a surface of hook fasteners, or male fastening tape, secured to the outside face of the loop strap. A characteristic of the fastening tape allows the inside face of the loop strap to engage any of various selectable locations on the outside face of the loop strap, thereby permitting the hair tie to tie a lock of hair that may vary considerably in size.

Embodiments of the invention desirably contain a combination of features that improve the functional characteristics and aesthetic appeal of the invention. For example, one embodiment of the invention may comprise the generally planar, elongated element or loop strap having an inside face and an outside face; an elastic loop secured to the inside face of the loop strap; and a surface of loop fastening tape attached to the inside face of the element or loop strap, and a corresponding surface of hook fastening tape is attached to the outside face of the loop strap. The lock of hair to be tied threads through the elastic loop, which holds the hair in position until the loop strap ties the hair. To tie the hair, the loop strap encircles the lock of hair in a belt-like fashion, and the fastening tape surfaces detachably engage to secure the lock of hair into a pony tail, braid or dred lock.

An alternate embodiment of the invention may comprise the generally planar, elongated element or loop strap having an inside face and an outside face; a friction pad attached to the inside face of the loop strap; a surface of loop fastening tape attached to the inside face of the element or loop strap; a corresponding surface of hook fastening tape attached to the outside face of the loop strap; and a stiffening element secured to the loop fastening tape in a sandwich-like manner between the loop fastening tape and the inside face of the loop strap. The hair tie encircles the lock of hair in a belt-like fashion, and the fastening tape surfaces detachably engage to secure the lock of hair into a pony tail, braid or dred lock.

The friction pad provides a surface which grips the lock of hair after the loop strap has encircled the lock of hair. The friction pad prevents the hair tie from slipping from the desired position on the lock of hair.

The stiffening element has the capability of being deformed and maintaining its deformation. The stiffening element provides increased stability and forming capabilities to an end portion of the loop strap and allows the user to "tie" different amounts of hair on any one occasion.

When only a small portion of the hair is encircled by the hair tie, a portion of the loop fastening tape may extend beyond and not engage the area of the male fastening tape and make the hair tie appear "unfinished". To prevent this "unfinished" look, the stiffening element allows the wearer to mold the extended end of the hair tie around the hair tie. The stiffening element enables the loop strap to maintain its molded shape. This gives the hair tie a finished look on the hair, rather than the extended end of the loop strap sticking straight out.

Preferably, the stiffening element is flexible metal foil such as aluminum. Alternatively, other types of metal foil such as tin or a wire mesh, such as that used in window screens, or plastic may be used in place of the aluminum foil.

The preferred embodiment the invention includes a first layer of a generally planar thin resilient reinforcing element having adhesive laminated on both sides, a second layer of a generally planar, elongated member adhered to one side of the reinforcing element, a thin stiffening element adhered to one end of the other side of the reinforcing element and a friction pad adhered to the reinforcing element adjacent to the stiffening element. The friction pad includes a hole for passing an elastic loop therethrough and capturing the ends of the elastic loop. Fibrous loop fastening tape attaches to the stiffening element and detachably engages with hook fastening tape attached to the opposite end of the reinforcing element on the fabric side.

The resilient reinforcing element adheres to one side of the generally planar, elongated member. The member is sufficiently flexible to allow the hair tie encircle a lock of hair in a belt-like fashion. By sufficiently flexible, it is meant that the member may be made from one or more of a variety of material or fabrics including but not limited to suede, leather, polyester, silk, cotton or vinyl. The reinforcing element provides the overall support to the hair tie and provides a surface on which all other components directly or indirectly are attached. The reinforcing elements is resilient so that it will not distort the circular shape of the loop strap as it encircles the hair. Preferably, the reinforcing element is a polyester film characterized by high tensile strength, such as mylar TM.

A stiffening element is interposed between the female fastening tape and reinforcing element. The stiffening element has the capability of being deformed and maintaining its deformation. The stiffening element provides increased stability and forming capabilities to an end portion of the loop strap and allows the user to "tie" different amounts of hair on any one occasion.

When only a small portion of the hair is encircled by the hair tie, a portion of the female fastening tape may extend beyond and not engage the area of the male fastening tape and make the hair tie appear "unfinished". To prevent this "unfinished" look, the stiffening element allows the wearer to mold the extended end of the hair tie around the hair tie. The stiffening element enables the loop strap to maintain its molded shape. This gives the hair tie a finished look on the hair, rather than the extended end of the loop strap sticking straight out. Preferably, the stiffening element is flexible metal foil such as aluminum. Alternatively, other types of metal foil such as tin or a wire mesh, such as that used in window screens, or plastic may be used in place of the aluminum foil.

A friction pad attaches to the area of the reinforcing element adjacent to the stiffening element. The friction pad provides a surface which grips the lock of hair after the loop strap has encircled the lock of hair. The friction pad prevents the hair tie from slipping from the desired position on the lock of hair.

An elastic loop extends through a hole in the friction pad. The elastic loop holds the hair firmly in place before the loop strap encircles the lock of hair. The ends of the elastic loop are desirably interposed between the friction pad and the reinforcing element and are held in place by the friction pad and adhesive.

To use the invention, the wearer gathers an amount of hair desired to be held in a pony tail, braid or dred lock and threads it through the elastic loop until the hair tie is in the desired position on the hair. The hair is initially held in place by the elastic loop. Then, the wearer encircles the hair with the loop strap in a belt-like fashion so that the corresponding pieces of fastening tape attached to the hair tie detachably engage. The fastening tape connection resists forces in a plane substantially parallel to the connection securely holding the hair in place. However, the male and female pieces of the fastening tape that form the connection may be easily separated by normal peeling forces. The friction pad encircles a substantial portion of the pony tail and prevents the hair tie from slipping from its intended position on the pony tail.

The circumference of the hair tie can be selectively varied since the ends of the hair tie may engage each other at various selectable locations. The selectable locations that the ends engage depend on the amount of hair that is being tied and how tight the wearer desires the hair tie. When a small amount of hair is tied into a pony tail, a portion of the female fastening tape may extend beyond and not engage the male fastening tape, causing the end of the hair tie to stick out and appear "unfinished." If this occurs, the user is able to mold the extended end of the hair tie around the hair tie to finished appearance. give the hair tie a finished appearance.

When the hair tie is in the proper position on the wearer's hair, decorative ornaments are visible to a third person. The ornaments may be placed on the fabric portion of the hair tie or attached to a tail. The tail is an extension of the hair tie. It provides an additional surface for mounting decorative ornaments such as beads, studs, rhinestones, jewelry, braided rope, ribbon, etc. The hair tie and tail also provide a surface to emboss or print names or logos. In this manner, the hair tie may be decorated to the preference of the user.

The hair tie may be made in various sizes to allow the user flexibility in the arrangement of his or her hair. For example, large hair ties may be used to hold in place one large pony tail, comprising substantially all of the user's hair. Alternatively, the user may elect to use numerous smaller sized hair ties to arrange his or her hair in smaller pony tails. In this manner, the user may decorate his or her hair with various hair ties in a variety of positions.

It is a feature of the invention to provide a hair tie capable of tying different sizes of hair locks. Therefore, a person can put all of his or her hair in one single hair tie, or multiple smaller locks of hair, each into a separate hair tie.

It is an object of the invention to provide a flexible closure device for hair, principally for use with and to hold hair in "pony tails". The invention may be constructed using any variety of fabrics and materials such as suede, leather, polyester, silk, cotton and vinyl.

In addition, an advantage of the invention is that the hair tie that does not use knots but enables the user to securely fasten the hair tie around a lock of hair. The hair tie is easy to apply and remove from the hair and securely holds the hair in a pony tail.

Of particular advantage is the fact that each end of the hair tie is detachably connected to the other. The connection resists forces in a plane substantially parallel to the connection securely holding the hair in place.

However, the connection may be easily separated by normal peeling forces.

Furthermore, it is another feature of the invention to provide a hair tie which not only is capable of efficiently securing hair, but also is an attractive fashion accessory. The hair tie may be furnished with decorative pins, beads, decorative fabrics or other ornaments.

Other aspects of the invention will be apparent from a description of certain preferred embodiments below and will be more specifically identified in the appended claims.

DETAILED DESCRIPTION

Figure 1:
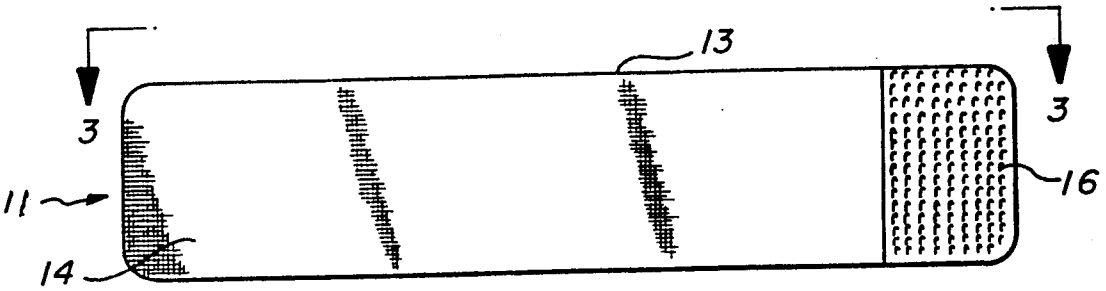
FIG. 1 is an elevation view illustrating one side of an embodiment of the invention.
Figure 2:
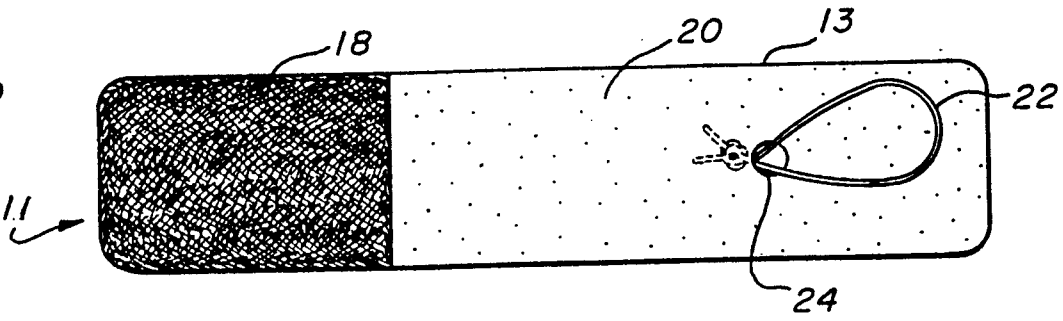
FIG. 2 is an elevation view illustrating the opposite side of the embodiment of FIG. 1.
Figure 3:
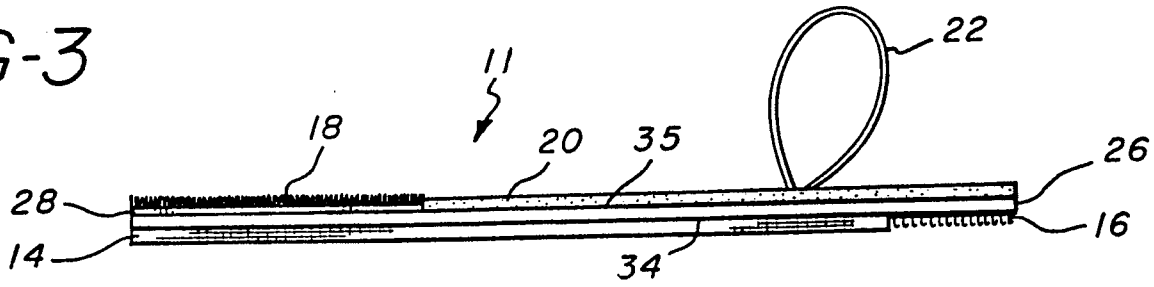
FIG. 3 is an exaggerated plan view of the layered components of the embodiment of FIG. 1.
Figure 5:
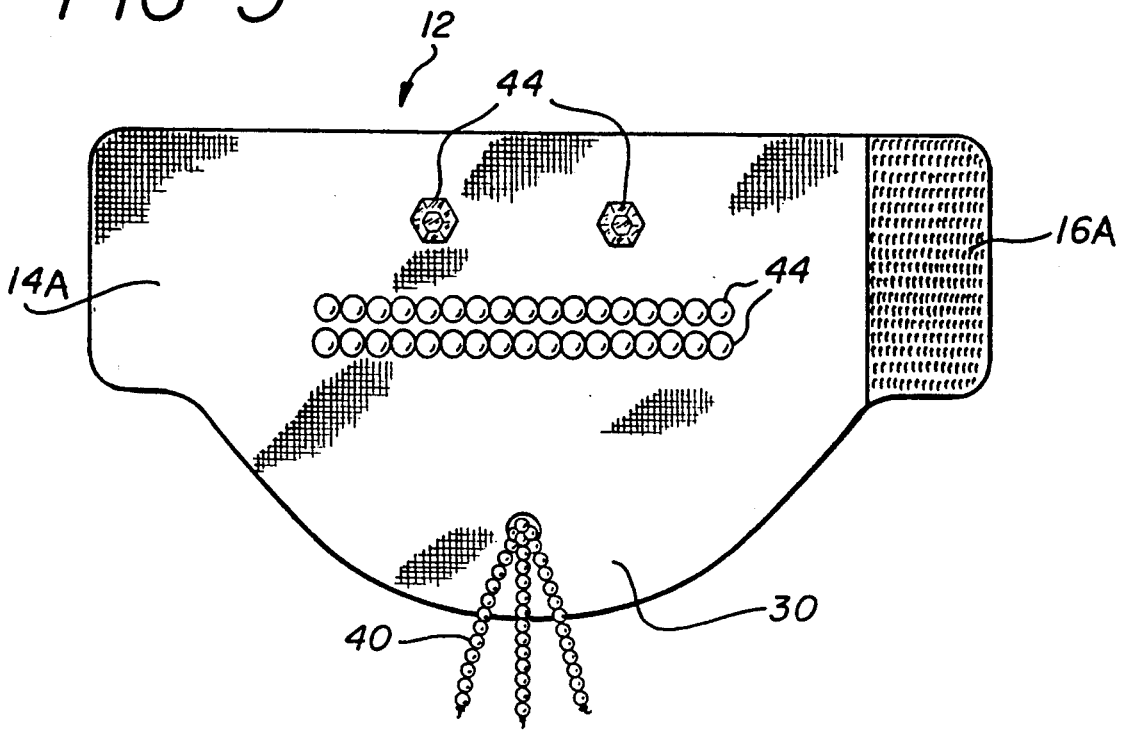
FIG. 5 is an elevation view illustrating one side of an alternate embodiment of the invention.
Figure 6:
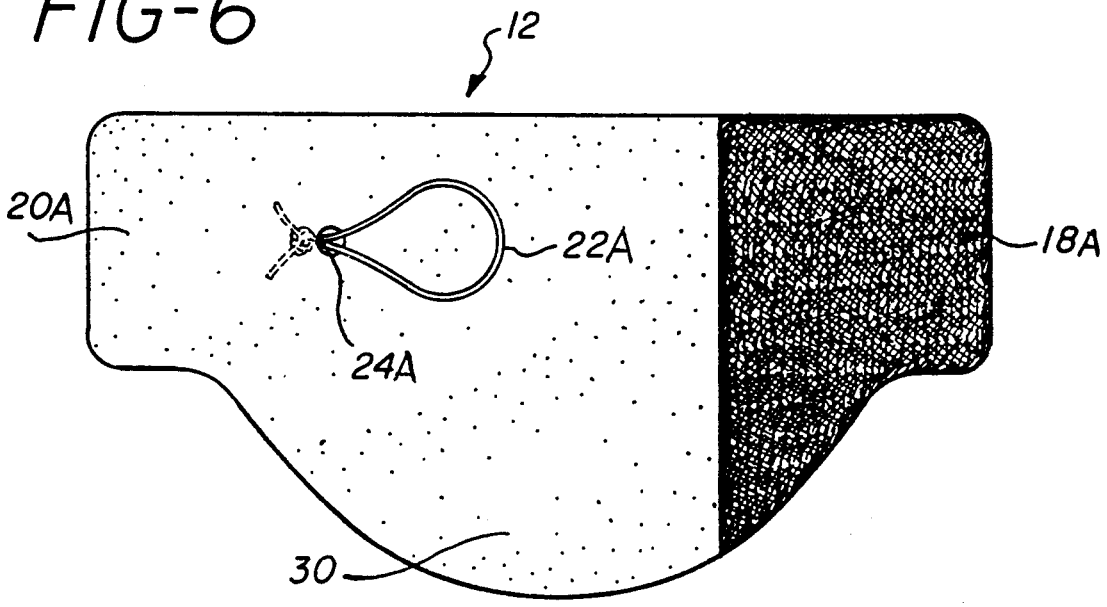
FIG. 6 is an elevation view illustrating the opposite side of the embodiment of FIG. 5.

Referring to FIGS. 1 through 3, the foundation for the loop strap hair tie 11, as a unit, is a generally planar rectangular-shaped strap 13. Alternatively, the invention may include a tail 30 attached to the rectangular-shaped strap 13 as illustrated in FIGS. 5 and 6. By saying that the tail 30 is "attached" to the loop strap 13, it is meant either that the loop strap 13 and tail 30 are constructed from a continuous piece of fabric or material or that the loop strap 13 and tail 30 are constructed from separate pieces of fabric or materials and fastened together at abutting edges in generally coplanar orientation. The hair tie 11 may be assembled using one or more of a variety of materials or fabrics including, but not limited to, suede, leather, polyester, silk, cotton or vinyl.

Referring to FIG. 1, the hair tie 11 is rectangular in shape with rounded corners. Generally, the overall size range of this embodiment is approximately 3 to 5 inches long and between about 1 and 1½ inches wide. The exact size of the hair tie 11 is determined by the intended range of the amount of hair to be tied by the hair tie. For example, the hair tie 11 is longer for large amounts of hair to be tied and shorter for smaller amounts of hair to be tied.

Figure 4:
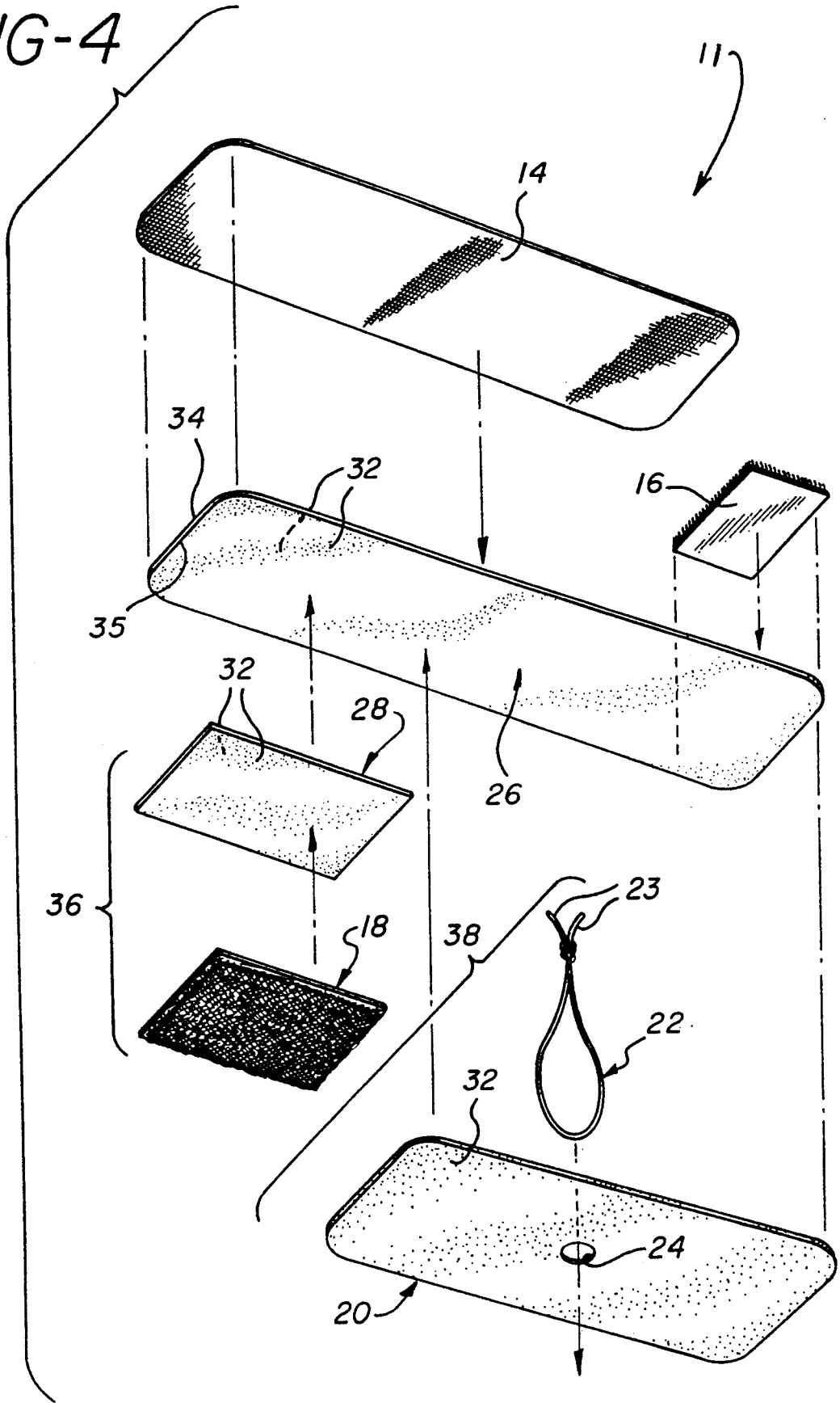
FIG. 4 is an isometric view illustrating assembly of a single unit of the embodiment of FIG. 1.

The construction of a single hair tie 11 is detailed in FIGS. 3 and 4. The dimensions that follow are for illustrative purposes only and are not intended to limit the size of the invention. As mentioned, the size of the invention is dependent upon how much hair the hair tie is intended to tie.

The supporting structure of the invention is a generally planar thin resilient reinforcing film 26 having adhesive 32 laminated on one side. Preferably, the reinforcing film 26 is a polyester film characterized by high tensile strength, such as Mylar TM that may be purchased from the Dupont Company in Bloomington, Del. The reinforcing film 26 may be any of a variety of thicknesses, but preferably it is about 0.003 inches thick. The reinforcing film 26 encompasses the entire surface area of the hair tie 11 and in this example is cut to be 5 inches long by 1⅜ inches wide. The reinforcing film 26 provides a surface on which all the other components mount directly or indirectly. The preferred adhesive 32 is catalog number 9460 manufactured by the 3M Company, Minneapolis, Minn., which is a sheet of adhesive material supplied with a wax paper backing 33 (not shown) on both sides of the adhesive. The adhesive 32 is cut to the same size as the reinforcing film 26 and laminated to one side 34 of the reinforcing film 26 using pressure.

A layer of fabric 14 is laminated by pressure to the adhesive side 34 of the reinforcing film 26. The fabric 14 may be any of a variety of fabrics and materials such as suede, leather, polyester, silk, cotton and vinyl. The fabric is the same width as the reinforcing film 26, but is cut ½ inch shorter than the reinforcing film 26. In this example, the fabric 14 is 4½ inches long and 1⅜ inches wide. The fabric 14 is laminated to the reinforcing film 26 so that one end of the fabric 14 corresponds to one end of the reinforcing film 26.

Attached to the remaining surface of reinforcing film 26 on side 34 is hook fastening tape 16. The hook tape 16 is ½ inch long and 1⅜ inches wide. The hook fastening tape 16 is a surface consisting of multiple rows of hook fasteners, preferably catalog number 5400, supplied by Rip 'N Grip Industries, Chatsworth Calif. This specific fastening tape is preferred because it has a high density of hooks per square inch, thus providing increased connecting properties over a small amount of contacting surface area. Also, an additional advantage of this fastening tape is that it is less apt to catch the wearer's hair when the hair tie is fastened.

On the adjacent side 35 of the reinforcing film 26, a stiffening element 28, the loop fastening tape 18, a friction pad 20 and an elastic loop 22 is attached to the reinforcing film 26. The stiffening element 28 must be flexible so that it may be easily shaped and yet maintain its deformation. In the preferred embodiment, the stiffening element 28 is aluminum foil #1100 soft and 0.006 inches thick. It is manufactured by A. J. Oster, 22833 La Palma Avenue, Yorba Linda, Calif. In this example, the size of the stiffening element 28 is 1½ inches long by 1⅜ inches wide. Alternatively, other types of metal foil such as tin or a wire mesh, such as that used in window screens, may be used in place of the aluminum foil.

A foil subassembly 36 comprises the stiffening element 28 and the loop fastening tape 18. Adhesive 32, cut to the same size as the stiffening element 28, is laminated on both sides of the foil 28 using pressure. On one side of the foil 28, the loop fastening tape 18, which is also cut to the same dimensions as the stiffening element of 28, attaches to the stiffening element 28. The loop fastening tape 18 is a surface consisting of a fibrous loop fastening material, preferably, catalog number 4600, also supplied by Rip 'N Grip Industries. This subassembly 36 then adheres to one end of the reinforcing film 26 as shown in FIG. 4.

A friction pad subassembly 38 comprises the friction pad 20 having adhesive 32 laminated on one entire side and an elastic loop 22 passing through a hole 24 in the friction pad 20. The friction pad subassembly 38 adheres to the remaining surface area of the reinforcing film 26, adjacent to the foil subassembly 36. Preferably, the friction pad 20 is a foam pad, 0.062 inches neoprene sponge-hard, manufactured by Rubatex Corporation, Bedford, Va. This foam pad is preferred since it provides a non-slip surface and is flexible and supple to allow the hair tie 12 to mold around the hair. Alternatively, the friction pad 20 may be made from other rubber-type substances, such as neoprene, so long as it provides a non-slip surface and is flexible. In this illustration, the foam pad 20 is cut to be 3½ inches long by 1⅜ inches wide.

The friction pad 20 includes a hole 24, about 3/16ths of an inch in diameter, for passing an elastic loop 22 therethrough and capturing the ends 23 of the elastic loop. The hole 24 is centrally located in the friction pad 20 and about 1⅜ths inches from the end of the friction pad 20 as shown in FIG. 2. The size of the elastic loop 22 varies depending on the amount of hair that the hair tie 11 can hold in a pony tail. Generally, the overall length of the elastic loop 22 and ends 23 ranges from approximately 3 to 5½ inches in length and approximately ⅛th of an inch in circumference. The size of the loop ranges from approximately 1 to 2 inches in length and has approximately a 190–200 percent elastic stretch. The preferred elastic may be purchased from United Stretch Design, 90 Cherry Street, Hudson, Mass, 01749. The elastic loop 22 passes through hole 24 so that the loop ends 23 adhere to the adhesive 32 laminated to the friction pad 20.

Figure 14:
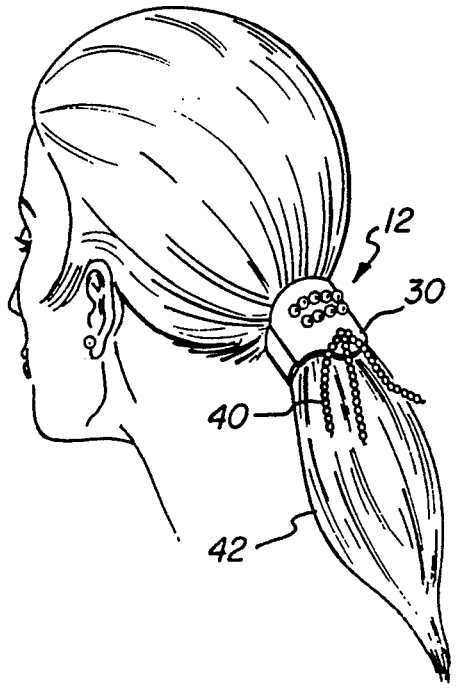
FIG. 14 is a view depicting the embodiment of FIG. 5 functioning in its stated purpose.

FIGS. 5 and 6 represent two views of an alternate embodiment of the invention. This alternate embodiment is the hair tie 12 having a tail 30 extending from the bottom long edge of the rectangular-shaped strap 13. The actual length of the tail 30 is not critical, but generally its length ranges from about 1 to 2 inches wider at its peak than the width of the rectangular-shaped strap 13. The assembly of this embodiment is similar to that of the embodiment of FIGS. 1 and 2 except that all the components are sized to correspond to the added dimensions of the tail 30. The tail 30 provides a surface for mounting decorative ornaments 44 such as beads, studs, rhinestones, jewelry, etc. The tail 30 also provides a mounting surface for an optional tailpiece 40 for decoration, which may be a string of beads or braided fabric, ribbon, etc. as illustrated in FIGS. 5 and 14. The hair tie and tail also provide a surface to emboss or print names or logos. In this manner, the hair tie 12 may be decorated to the preference of the user.

Alternatively, the hair tie 12 may be made in any of various shapes that incorporate the features previously described. For example, the hair tie 12 could be shaped in accordance with holidays or observances, such as a heart for Valentine's Day.

A preferred method of assembly enables mass production of the hair tie 12. The method of mass production takes advantage of the layered construction of the components comprising the hair tie 12 and the fact that each component may be purchased in considerable lengths supplied in rolls.

Figure 7:
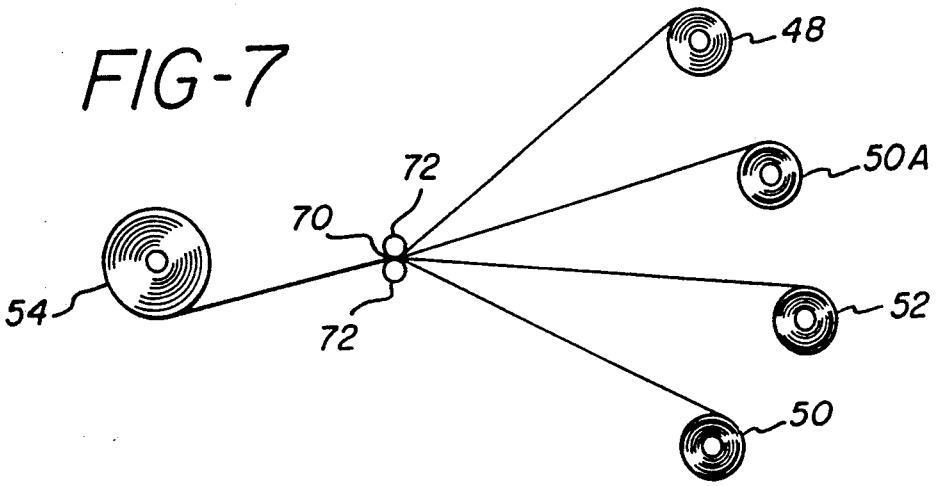
FIG. 7 is a view illustrating the assembly of a roll of the foil subassembly.

FIG. 7 illustrates the method to assemble a roll 54 of the foil sub-assembly 36 from rolls of the individual components that comprise the foil sub-assembly 36. Rolls of the loop fastening material 48, adhesive 50A, foil 52 and adhesive 50 are aligned in the stated respective descending order in a common vertical plane and attached to spools that rotate at a single constant linear speed. The common vertical plane alignment causes the loop fastening material 18, adhesive 32, stiffening element 28 and adhesive 32 to be aligned in the required corresponding layers. The wax paper 33, is not shown, is removed from both sides on adhesive roll 50A, but the wax paper 33 on adhesive roll 50 is only removed on the face that attaches to the foil 28 unwinding from the foil roll 52. The ends of the rolls are threaded between rollers 72 that form nip 70. The pressure of nip 70 causes the adhesive to adhere to each component and the resulting product from the nip winds onto a pickup spool as foil sub-assembly roll 54. The pickup spool travels at the same linear speed as rolls 48, 50, 50A and 52.

Figure 8A:
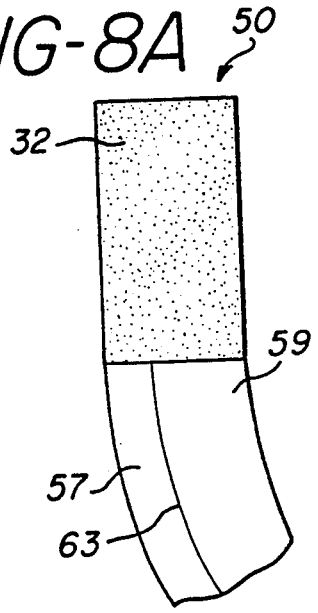
FIG. 8A is a view of a roll adhesive showing the wax paper sections.
Figure 8:
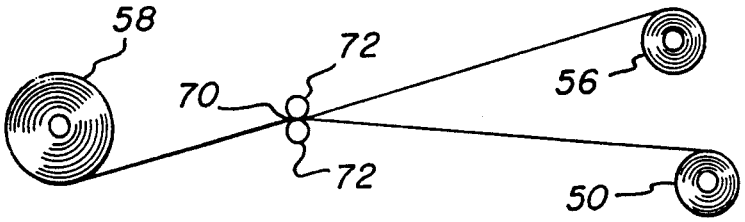
FIG. 8 is a view illustrating the assembly of a roll of the friction pad subassembly.

FIG. 8 illustrates the method to assemble a roll 58 of the friction pad sub-assembly 38 from rolls of the individual components that comprise the friction pad sub-assembly 38. Rolls of the foam material 56 and adhesive 50, are aligned in the respective descending order in a common vertical plane and attached to spools that rotate at a single constant linear speed. The wax paper 33 on adhesive roll 50 is only removed on the face that attaches to the foam 20 unwinding from the foam roll 56. FIG. 8A illustrates the wax paper 33 on the opposite face slit 63 in one lengthwise location to allow staged removal of wax paper sections 57 and 59 later in the process. The ends of each roll are threaded between rollers 72 that form nip 70. The pressure of nip 70 causes the adhesive to adhere to the foam 20 and the resulting product from the nip winds onto a pickup spool as friction pad sub-assembly roll 58. The pickup spool travels at the same linear speed as rolls 56 and 50.

Figure 9:
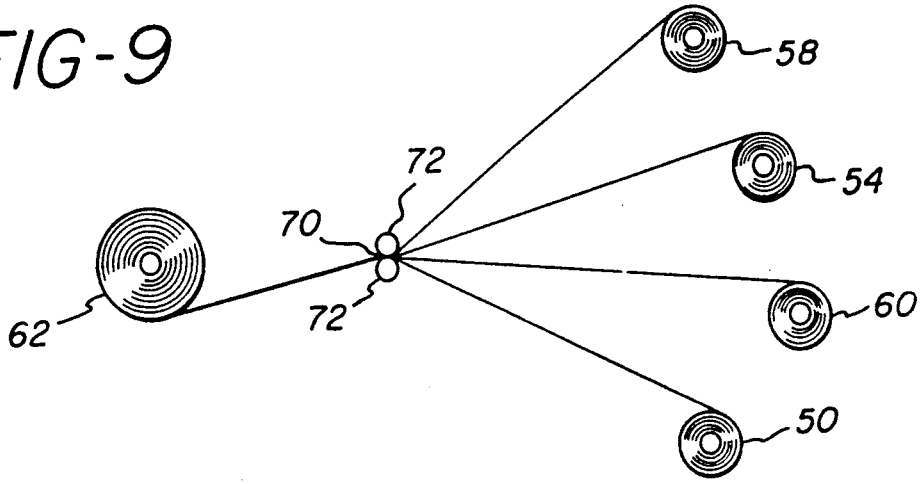
FIG. 9 is a view illustrating the assembly of a roll of the reinforcing element subassembly.

FIG. 9 illustrates the method to assemble a roll of a reinforcing film sub-assembly 62 from a foil sub-assembly roll 54, a foam pad sub-assembly roll 58, a roll of reinforcing film 60 and a roll of adhesive 50. Rolls 58 and 54 are aligned in the same horizontal plane so they are laminated on the reinforcing film 26 adjacent to each other in the same horizontal plane as shown in FIG. 4. Also, roll 58 is aligned as such so that wax paper section 59 is adjacent to roll 54. The remaining wax paper surface 33 on roll 54 is removed and wax paper section 57 on roll 58 is removed. Wax paper sections 57 and 59 remain on the foam 20 for removal later in the process. The wax paper 33 on the adhesive roll 50 facing the reinforcing film 26 is removed and the wax paper 33 on the opposite face remains on the adhesive 32. Rolls 58 and 54, aligned in a in a horizontal plane, are aligned in a common vertical plane with rolls 60 and 50 in the stated descending order. The ends of each roll are threaded between rollers 72 that form nip 70. The pressure of nip 70 causes the adhesive to adhere to each component and the resulting product from the nip winds onto a pickup spool as reinforcing film sub-assembly roll 62. As a result of the wax paper section 59 remaining on the adhesive 32, a portion of the foam sub-assembly 38 does not adhere to the reinforcing film 26.

Figure 10:
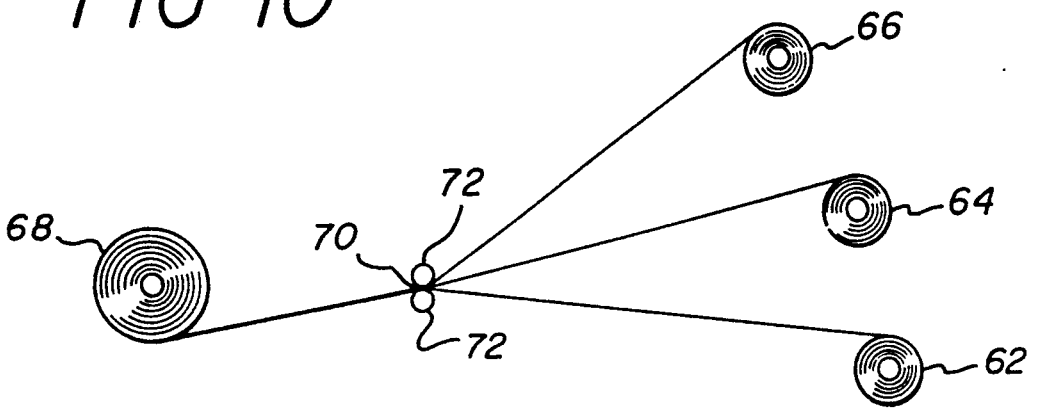
FIG. 10 is a view illustrating the assembly of a roll of the final product.

FIG. 10 illustrates the process of attaching the decorative fabric 14 and hook fastener 16 onto the reinforcing film sub-assembly 62. Decorative fabric roll 66 and hook fastener roll 64 are aligned in the same horizontal plane so they are laminated onto the reinforcing film sub-assembly 62 adjacent to each other in the same horizontal plane as shown in FIG. 4. The remaining wax paper 33 on the outside face of the reinforcing film sub-assembly roll 62 is removed. Rolls 66 and 64, aligned in a horizontal plane, are aligned in a common vertical plane with roll 62 in the stated descending order. The ends of each roll are threaded between rollers 72 that form nip 70. The pressure of nip 70 and exposed adhesive 32 causes the fabric 14 and hook fastener 16 to adhere to the reinforcing film sub-assembly and the resulting product from the nip winds onto a pickup spool as finished product roll 68.

Figure 11:
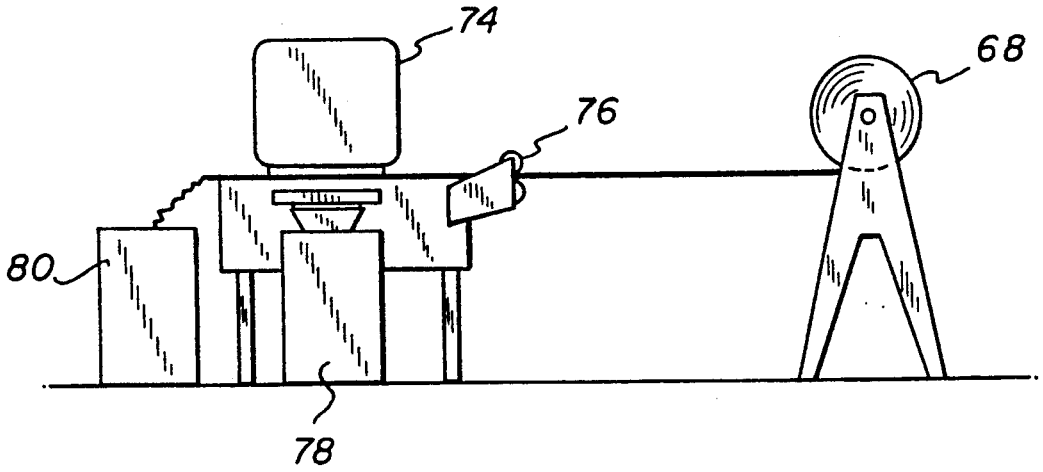
FIG. 11 is a view illustrating the process of die cutting the invention from a roll of the final product of FIG. 10.
Figure 12:
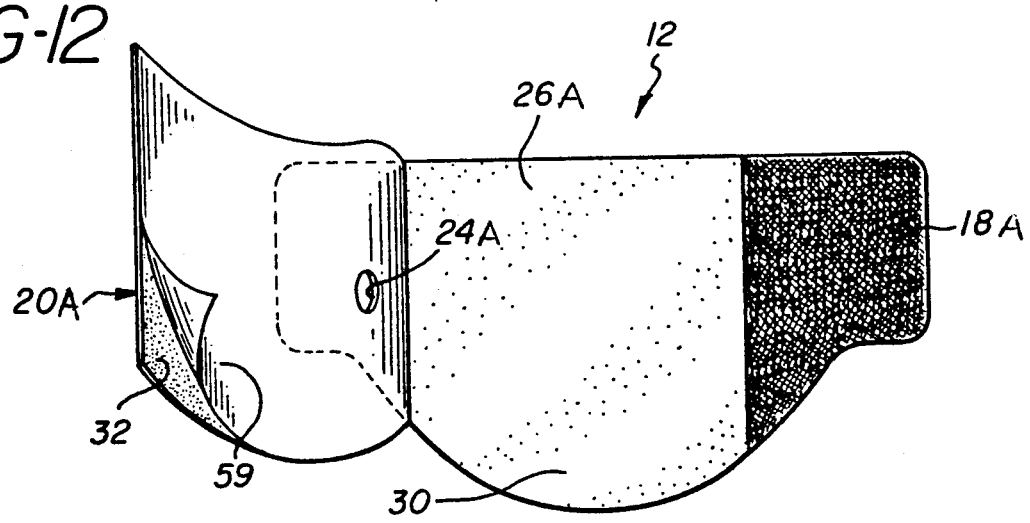
FIG. 12 is a view of a partially assembled alternate embodiment of the invention, after the process of FIG. 11.

FIG. 11 illustrates the finished roll 68 feeding into a die cutter 74 via feed rolls 76. The die cutter stamps out individual hair ties 12 without an elastic loop 22. The individual hair tie 12 is deposited into a finished goods hopper 78 and the scrap is deposited into scrap hopper 80. The advantages of this die-cutting method is that it allows mass production of a uniform hair tie 12. Additionally, the die-cutting method gives the flexibility to vary easily the shape and appearance of the hair tie 12. Die patterns may be easily manufactured in various shapeps that will emboss emblems, names, etc. on the hair ties 12, or produce cutouts in the hair tie.

As currently practiced, hole 24A through foam 20A is formed using a punch in a hand operation. Hole 24 is punched-out in the area of wax paper section 57. After hole 24A is punched in the foam 20, wax paper section 59 may be peeled away, exposing adhesive 33. The elastic loop 22A is inserted through the hole 24A so that the loop 23A, not shown will adhere to the adhesive 32A. The loop 23A, not shown are sandwiched between the foam 20A and reinforcing film 26 and securely held in place by the adhesive 32A.

Additionally, before the foam pad 20A attaches to the reinforcing film 26A, a tail piece 40 may be attached to the tail area 30 by placing a portion of the tail piece 40 between the foam pad 20A and reinforcing film 26A so that the adhesive 32A holds the tail piece 40 in place. Optionally, the tail piece 40 may be attached to the tail 30 by attaching a post, similar to those found on pierced earrings, to the tail piece 40 and inserting the post through a pin hole in the fabric layer 14A and reinforcing film 26A. After inserting the post in the pin hole, the post is bent to secure the tail piece 40 in place. The bent post is sandwiched between the foam pad 20A and reinforcing film 26A and held in place by adhesive 32A. Alternatively, the tail piece 40 may be attached to the fabric layer 14 using adhesive.

Figure 13:
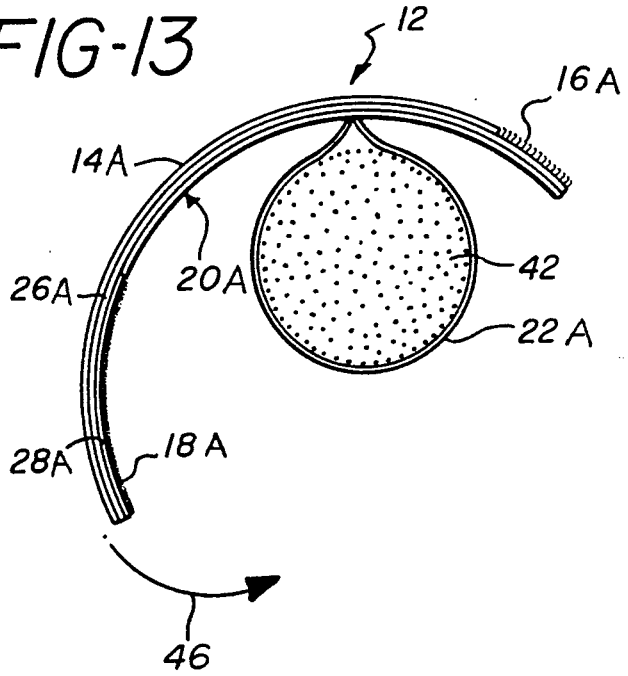
FIG. 13 is a plan view illustrating the placement of the embodiment of FIG. 5 onto a lock of hair.

As shown in FIG. 13, elastic loop 22A encircles a lock of hair 42 and initially holds the hair in place. The hair tie 12 wraps in the direction of arrow 46 around the lock of hair 42 in a beltlike fashion until the loop fastening tape 18A faces and detachably engages the hook fastening tape 16A, attached to the outside face of the hair tie 12. Depending upon the amount of hair being tied and how tight the wearer desires the hair tie 12, the loop fastening tape 18A can engage the hook fastening tape 16A at various selectable locations. The fastening tapes 16 and 18, when fastened together, strongly resist relative longitudinal movement, but, may be separated from one another by peeling the surfaces apart. If a portion of the loop fastening tape 18A extends beyond and does not engage the hook fastening tape 16A the stiffening element 28 allows the extended end to be molded around the hair tie 12 to give the hair tie 12 a finished look. The friction pad 20A maintains the hair tie 12 in position on the lock of hair.

After the hair tie is properly positioned on the lock of hair 42, decorative ornaments 44, located on the outside face of the hair tie, face outwardly from the pony tail as illustrated in FIG. 14. The decorative ornaments 44, along with an optional tailpiece 40 and imprinted names, are visible to others.

Modifications and changes from the specific form of the invention herein shown and described as a preferred embodiment will occur to those skilled in the art. All such modifications and changes not departing from the spirit of the invention are intended to be embraced within the scope of the appended claims.

Having thus described the invention, what is desired to protect by Letters Patent and hereby claim is:

1. A hair tie comprising:

a. a generally planar, elongated element having an inside face and an outside face;

b. an elastic loop secured to the inside face of the elongated element for threading a lock of hair therethrough;

c. a first fastening tape secured to the outside face of the elongated element;

d. a second fastening tape, made of material adapted to mate with the first fastening tape, secured to the inside face of the elongated element;

e. a stiffening element secured to the second fastening tape and sandwiched between the second fastening tape and the inside face of the elongated element;

the generally planar, elongated element being sufficiently flexible that the hair tie has a first position wherein the elongated element is extended and the second fastening tape is disengaged from the first fastening tape, and a second position wherein the hair tie encircles the lock of hair held in place by said elastic loop and the second fastening tape is detachably engaged at any of various selectable locations on the first fastening tape, therein retaining the encircled lock of hair.

2. The hair tie of claim 1 further comprising a friction pad, having a hole in captive cooperation with the elastic loop, secured to the inside face of the elongated element, wherein the friction pad in conjunction with the second fastening tape comprises the inside face of the elongated element.

3. The hair tie of claim 2, wherein the friction pad is a neoprene sponge.

4. The hair tie of claim 1 further comprising decorations attached to the outside face of the elongated element.

5. The hair tie of claim 1, wherein the elongated element further comprises a tail.

6. The hair tie of claim 5, further comprises decorations attached to the tail.

7. The hair tie of claim 1, wherein the second fastening tape is a fibrous loop fastening material and the first fastening tape is a hook fastening material.

8. The hair tie of claim 1, wherein the elongated element is made of a material from the group consisting of suede, leather, polyester, silk, cotton and vinyl.

9. The hair tie of claim 1, wherein the elongated element is made of a fabric from the group consisting of suede, leather, polyester, silk, cotton and vinyl.

10. A hair tie comprising:

a. a generally planar, elongated element having an inside face and an outside face;

b. a friction pad secured to the inside face of the elongated element;

c. a first fastening tape secured to the outside face of the elongated element;

d. a second fastening tape, made of material adapted to mate with the first fastening tape, secured to one end of the inside face of the elongated element; and e. a stiffening element secured to the second fastening tape and sandwiched between the second fastening tape and said one end of the inside face of the elongated element;

the generally planar elongated element being sufficiently flexible that the hair tie has a first position wherein the element is extended and the second fastening tape is disengaged from the first fastening tape, and a second position wherein the hair tie encircles a lock of hair and the second fastening tape is detachably engaged at any of various selectable locations on the first fastening tape, therein retaining the encircled lock of hair.

11. The hair tie of claim 10 wherein the stiffening element is flexible metal foil.

12. The hair tie of claim 10 wherein the friction pad is neoprene sponge.

13. The hair tie of claim 10 wherein the friction pad comprises a hole in captive cooperation with an elastic loop.

14. The hair tie of claim 10, wherein the second fastening tape is a fibrous loop fastening material and the first fastening tape is a hook fastening material.

15. The hair tie of claim 10, wherein the elongated element is made of a material from the group consisting of suede, leather, polyester, silk, cotton and vinyl.

16. The hair tie of claim 10, wherein the elongated element is made of a fabric from the group consisting of suede, leather, polyester, silk, cotton and vinyl.

17. The hair tie of claim 10 further comprising decorations attached to the outside face of the elongated element.

18. The hair tie of claim 10, wherein the elongated element comprises a tail.

19. The hair tie of claim 18, further comprising decorations attached to the tail.

20. A hair tie comprising:

a. a generally planar, elongated element having an inside face and an outside face;

b. decorations attached to the outside face of the elongated element;

c. a friction pad of neoprene sponge secured to the inside face of the elongated element and having a hole in captive cooperation with an elastic loop;

d. a first fastening tape secured to the outside face of the elongated element;

e. a second fastening tape, made of material adapted to mate with the first fastening tape, secured to the inside face of the elongated element; and f. a stiffening element secured to the second fastening tape and sandwiched between the second fastening tape and the inside face of the elongated element;

the generally planar elongated element being sufficiently flexible that the hair tie has a first position wherein the element is extended and the second fastening tape is disengaged from the first fastening tape, and a second position wherein the hair tie encircles a lock of hair and the second fastening tape is detachably engaged at any, of various selectable locations on the first fastening tape, therein retaining the encircled lock of hair.

21. The hair tie of claim 20, wherein the elongated element comprises a tail.

22. The hair tie of claim 21, further comprising decorations attached to the tail.

23. A hair tie comprising:

a. a first layer of a generally planar, elongated thin resilient reinforcing film having a first side and a second side;

b. a second layer of a generally planar, elongated member adhered to the first side of the reinforcing film;

c. a stiffening element adhered to a portion of the second side;

d. a friction pad having a hole, secured to a portion of the second side;

e. an elastic loop secured to the second side such that the elastic loop is in captive cooperation with the hole;

f. a first fastening tape secured to the first side, adjacent to the second layer of the generally planar, elongated member;

g. a second fastening tape, made of material adapted to mate with the first fastening tape, secured to the stiffening element such that the stiffening element is sandwiched between the second fastening tape and the reinforcing film; and the generally planar, elongated member being sufficiently flexible that the hair tie has a first position wherein the reinforcing film and member are extended and the first fastening tape is disengaged from the second fastening tape, and a second position wherein the hair tie encircles a lock of hair and the second fastening tape is detachably engaged at any of various selectable locations on the first fastening tape, therein retaining the encircled lock of hair.

24. The hair tie of claim 23, wherein the elongated member is made of a fabric from the group consisting of suede, leather, polyester, silk, cotton and vinyl.

25. The hair tie of claim 23, wherein the stiffening element is flexible metal foil.

26. The hair tie of claim 23, wherein the reinforcing film is a plastic sheet.

27. The hair tie of claim 23, wherein the friction pad is a neoprene sponge.

28. The hair tie of claim 23 wherein, the second fastening tape is a fibrous loop fastening material and the first fastening tape is a hook fastening material.

29. The hair tie of claim 23, wherein the elongated member is made of a material from the group consisting of suede, leather, polyester, silk, cotton and vinyl.

30. The hair tie of claim 23, further comprising decorations attached to the generally planar, elongated member.

31. The hair tie of claim 23, wherein the generally planar, elongated member further comprises a tail.

32. The hair tie of claim 31, further comprising decorations attached to the tail 33. A hair tie comprising:

a. a first layer of a generally planar, elongated thin resilient reinforcing film of a plastic sheet having a first side and a second side;

b. a second layer of a generally planar, elongated member adhered to the first side of the reinforcing film;

c. decorations attached to the generally planar, elongated member;

d. a stiffening element of flexible metal foil adhered to a portion of the second side;

e. a friction pad of a neoprene sponge having a hole, secured to a portion of the second side;

f. an elastic loop secured to the second side such that the elastic loop is in captive cooperation with the hole;

g. a first fastening tape secured to the first side, adjacent to the second layer of the generally planar, elongated member;

h. a second fastening tape, made of material adapted to mate with the first fastening tape, secured to the stiffening element such that the stiffening element is sandwiched between the second fastening tape and the reinforcing film; and the generally planar, elongated member being sufficiently flexible that the hair tie has a first position wherein the reinforcing film and member are extended and the first fastening tape is disengaged from the second fastening tape, and a second position wherein the hair tie encircles a lock of hair and the second fastening tape is detachably engaged at any of various selectable locations on the first fastening tape, therein retaining the encircled lock of hair.

34. The hair tie of claim 33, wherein the generally planar, elongated member further comprises a tail.

35. The hair tie of claim 34, further comprising decorations attached to the tail.

36. A method of fastening a lock of hair with a hair tie comprising:

a. a first layer of a generally planar thin resilient reinforcing film having a first side and a second side;

b. a second layer of a generally planar, elongated member adhered to the first side of the reinforcing film;

c. a stiffening element adhered to a portion of the second side;

d. a friction pad having a hole, secured to a portion of the second side;

e. an elastic loop secured to the second side such that the loop is in captive cooperation with the hole;

f. a first fastening tape secured to the first side, adjacent to the second layer of the elongated member;

g. a second fastening tape, made of material adapted to mate with the first fastening tape, secured to the stiffening element such that the stiffening element is sandwiched between the second fastening tape and the reinforcing film; and the generally planar, elongated member is sufficiently flexible that the hair tie has a first position extended and the first fastening tape is disengaged from the second fastening tape, and a second position wherein the hair tie is capable of encircling a lock of hair and the second fastening tape is capable of detachably engaging at any of various selectable locations on the first fastening tape, therein retaining an encircled lock of hair;

the method comprising the steps:

h. positioning the hair tie in its first position so the generally planar, elongated member faced outwardly from the lock of hair;

i. threading the lock of hair through the elastic loop;

j. positioning the hair tie to the desired position on the lock of hair;

k. encircling the lock of hair with the hair tie so the second fastening tape detachably engages at any of various selectable locations on a first fastening tape; and l. molding the hair tie to give the hair tie a finished look.

* * * * *